US011421858B2

(12) United States Patent
Jiang

(10) Patent No.: US 11,421,858 B2
(45) Date of Patent: Aug. 23, 2022

(54) STAGE LIGHT HAVING WIRELESS POWER SIGNAL TRANSMISSION SYSTEM

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 17/219,110

(22) Filed: Mar. 31, 2021

(65) Prior Publication Data

US 2021/0215321 A1 Jul. 15, 2021

Related U.S. Application Data

(63) Continuation of application No. PCT/CN2020/095828, filed on Jun. 12, 2020.

(30) Foreign Application Priority Data

Jun. 27, 2019 (CN) ..... 201920989976.4

(51) Int. Cl.
*F21V 14/02* (2006.01)
*H05B 47/19* (2020.01)
*F21W 131/406* (2006.01)

(52) U.S. Cl.
CPC ..... *F21V 14/025* (2013.01); *H05B 47/19* (2020.01); *F21W 2131/406* (2013.01)

(58) Field of Classification Search
CPC . F21V 14/025; H05B 47/19; F21W 2131/406
See application file for complete search history.

(56) References Cited

U.S. PATENT DOCUMENTS 9,723,699 B1 * 8/2017 Von Novak, III ..... H02J 5/005
2013/0010466 A1 * 1/2013 Cavenati ..... F21S 8/00 362/249.02
2016/0248603 A1 8/2016 Schleef et al.
2019/0313515 A1 10/2019 Jiang

FOREIGN PATENT DOCUMENTS

CN 103216783 A 7/2013
CN 206918904 U 1/2018
CN 107654973 A 2/2018
CN 108302429 A 7/2018
CN 210088600 U 2/2020

OTHER PUBLICATIONS

International Search Report for Application No. PCT/CN2020/095828, dated Sep. 2, 2020, 4 pages.

* cited by examiner

*Primary Examiner* — Anne M Hines
(74) *Attorney, Agent, or Firm* — Lerner, David, Littenberg, Krumholz & Mentlik, LLP

(57) ABSTRACT

A stage light having a wireless power signal transmission system includes a base, a U-shaped arm pivotally connected to the base, a light head pivotally connected between two holding arms of the U-shaped arm, and a driving assembly used to drive the U-shaped arm and the light head to rotate, in which a wireless power transmission device is provided at a connection portion between the U-shaped arm base and the base and/or between the U-shaped arm and the light head, and the wireless power transmission device includes a wireless power signal transmitting module and a wireless power signal receiving module matched with the wireless power signal transmitting module.

12 Claims, 3 Drawing Sheets

STAGE LIGHT HAVING WIRELESS POWER SIGNAL TRANSMISSION SYSTEM

CROSS REFERENCE TO RELATED APPLICATIONS

The present application is a continuation of International Application No. PCT/CN2020/095828, filed on Jun. 12, 2020, which claims priority from Chinese Patent Application No. 201920989976.4 filed on Jun. 27, 2019, all of which are hereby incorporated herein by reference.

TECHNICAL FIELD

The present invention relates to the technical field of stage lights, and specifically relates to a stage light having a wireless power signal transmission system.

BACKGROUND

A traditional stage light scanning system is mainly composed of an arm, an electric wire, a motor and the like of a light. Due to the fact that thru-axis positions of the stage light scanning system are connected via electric wires, friction between the electric wires and the arm causes wear and generates heat when the arm performs scanning horizontally and vertically, which accelerates the loss of the electric wires and affects the life of the wires while the electric wires also limit the maximum angle of rotation.

SUMMARY

The present invention provides a new stage light having a wireless power signal transmission system, which can achieve a long service life while an arm thereof can also rotate 360 degrees infinitely.

According to the present invention, the stage light having a wireless power signal transmission system includes a base, a U-shaped arm pivotally connected to the base, a light head pivotally connected between two holding arms of the U-shaped arm, and a driving assembly used to drive the U-shaped arm and the light head to rotate. A wireless power transmission device is provided at the connection portion between the base and the U-shaped arm and/or between the U-shaped arm and the light head. The wireless power transmission device includes a wireless power signal transmitting module and a wireless power signal receiving module matched with the wireless power signal transmitting module.

With the arrangement of the wireless power signal transmitting module and the wireless power signal receiving module, the present application achieves the rotation of the U-shaped arm, without electric cables and wires, by only relying on that wireless power signals of the wireless power transmission device transmits power to the driving assembly, so that the service life of the stage light is extended, and the U-shaped arm can rotate 360 degrees infinitely. When the stage light performs scanning, the wireless power signal transmitting module works to convert the electric energy into an electromagnetic wave or a magnetic field, the wireless power signal receiving module senses the magnetic field or the electromagnetic wave of the wireless power signal transmitting module and converts the magnetic field or the electromagnetic wave into electric energy, then the wireless power signal receiving module transmits the electric power to the driving assembly, and the driving assembly rotates the U-shaped arm to realize scanning.

Preferably, the wireless power transmission device includes a wireless power signal transmitting module and a wireless power signal receiving module that is matched with the wireless power signal transmitting module through an electromagnetic induction wireless power signal, an electromagnetic resonance wireless power signal, a magnetically coupled wireless power signal, or a microwave wireless power signal.

Preferably, the wireless power signal transmitting module includes a transmitting coil, the wireless power signal receiving module includes a receiving coil, and the transmitting coil and the receiving coil are both circular and are provided opposite each other.

Further, the wireless power signal transmitting module includes an oscillator and the transmitting coil, in which the oscillator is provided before the transmitting coil to convert direct current (DC) to alternating current (AC); the wireless power signal receiving module includes the receiving coil and a rectifier, in which the rectifier is provided after the receiving coil to convert AC to DC.

Further, when signal transmission is performed between the wireless power signal transmitting module and the wireless power signal receiving module via microwave wireless power signals, an oscillator radio frequency signal source converts the direct current/signal into a microwave signal, that is, DC-RF. The microwave power is amplified by a power amplifier (multi-stage) and radiated to a free space, and then a rectifier antenna receives and rectifies the microwave energy to provide DC power for the load and display signals. The radio frequency signal source is made using a voltage-controlled oscillator (VCO) and a phase-locked loop (PLL), and is generally composed of a transistor, two ordinary capacitors, a varactor diode and an inductor, which is a basic Clapp LC voltage-controlled multi-resonant oscillator. A working process of the PLL is as follows. A radio frequency signal generated by the oscillator is divided into two signals, one is for output while the other is frequency divided by a program frequency divider and then compared with external reference signals. If the output frequency signal is different from the reference signal in phase, it shows that the output frequency is unstable. At this time, the input voltage of the oscillator needs to be adjusted, and then the output frequency that has a specific relationship with the input voltage is adjusted, so that the phase of the output frequency is the same as that of the reference signal, and the frequency phase is locked.

The wireless power signal transmitting module and the wireless power signal receiving module can also transmit power through the electromagnetic induction wireless power signal, which also realizes wireless transmission of electric energy from the transmitting coil to the receiving coil through the principle of electromagnetic induction. The wireless power signal transmitting module and the wireless power signal receiving module can also transmit power through the electromagnetic resonance wireless power signal. The wireless power signal transmitting module causes the electromagnetic wave to spread in the entire space, and the wireless power signal receiving module resonates at a corresponding specific frequency so as to realize energy transfer.

Preferably, the transmitting coil and the receiving coil are both sleeved on the pivot shaft between the U-shaped arm and the base.

Preferably, a wireless power transmission device is provided at a connection portion between the base and the U-shaped arm, the wireless power signal transmitting module is provided on the base, and the wireless power signal receiving module is provided on the U-shaped arm for rotation with the U-shaped arm.

Preferably, the driving assembly includes a vertical-axis motor that drives the U-shaped arm to rotate and is located in the base. The vertical-axis motor drives the U-shaped arm to rotate in a vertical direction.

Preferably, a wireless power transmission device is provided at the connection portions between the U-shaped arm and the light head, the wireless power signal transmitting module is provided on the U-shaped arm, and the wireless power signal receiving module is provided on the light head to rotate with the light head. Further preferably, a wireless power transmission device is provided at the connection portions between the two holding arms of the U-shaped arm and the light head.

Preferably, the driving assembly includes a horizontal-axis motor that drives the light head to rotate, in which the horizontal-axis motor is located in the U-shaped arm and electrically connected to the wireless power signal receiving module. The horizontal-axis motor drives the light head to rotate in a horizontal direction.

Preferably, the stage light having a wireless power signal transmission system further includes a control unit, and the base is provided with a control panel that is matched with the control unit and is used to display and control the stage light having a wireless power signal transmission system.

Preferably, the wireless signal transmission device is provided at the connection portions between the base and the U-shaped arm and/or between the U-shaped arm and the light head, and includes a signal transmitting unit and a signal receiving unit. The control signals between the base and the U-shaped arm and/or between the U-shaped arm and the light head is transmitted through the wireless signal transmission device without a wired connection, which is convenient for the base and the U-shaped arm and/or the U-shaped arm and the light head to achieve a relatively infinite rotation.

Further preferably, electromagnetic waves are used to transmit signals between the signal transmitting unit and the signal receiving unit, and both the signal transmitting unit and the signal receiving unit use circular coils. The control signal of the stage light having a wireless power signal transmission system is modulated by radio frequency 2.4 G or 5.8 G and transmitted by the signal transmitting unit, and then the signal received by the signal receiving unit is supplied to the driving assembly to complete a specified effect. When powered on, the radio frequency signal is automatically assigned with a unique identification number for matching in a frequency hopping mode, so that data of other devices can be prevented from being received by mistake, and the communication quality can be effectively improved. In addition, the antenna uses a circular appearance, which have the advantage that stable signal reception can be ensured during rotation of the U-shaped arm and the light head, and a situation can be avoided that the signal will be strong and weak from time to time due to distance change in relative movement of a traditional antenna.

Preferably, optical communication is adopted between the signal transmitting unit and the signal receiving unit. The optical communication cannot be interfered by electromagnetic waves, and the signal transmission is more stable.

Preferably, the driving assembly further includes a motor driving control board that is electrically connected with the vertical-axis motor and the horizontal-axis motor.

Compared with the prior art, some beneficial effects of the present invention can be obtained. According to the present application, the stage light has no electric wires at the thru-axis positions, and uses the wireless power transmission device to transmit power, so that the light may not be bounded by the wires when performing scanning, i.e., horizontal and vertical movements, the problem of frayed wires is avoided, the service life of the stage light can be significantly extended, and the light head can rotate 360 degrees infinitely without bounding of the electric wires.

Figure 1:
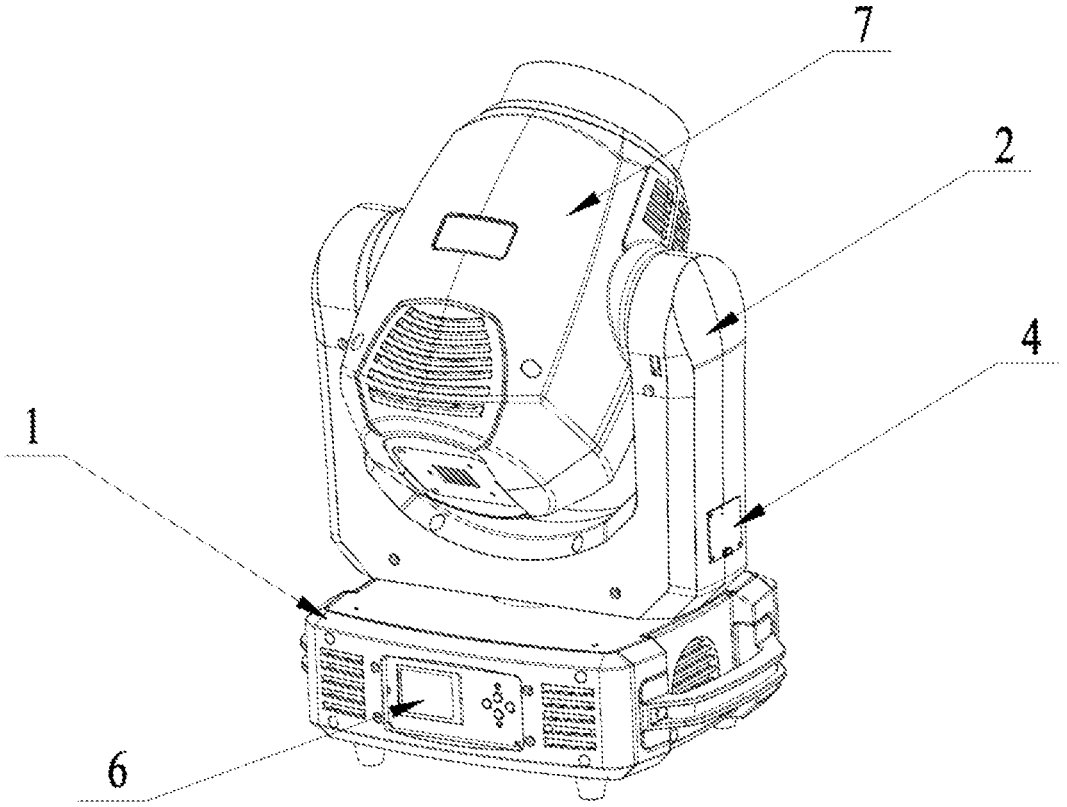
FIG. 1 is a schematic view showing an integral structure of a stage light having a wireless power signal transmission system according to an embodiment.

Reference Numerals: 1, base; 2, U-shaped arm; 31, vertical-axis motor; 32, horizontal-axis motor; 4, motor driving control board; 5, wireless power transmission device; 51, transmitting coil; 52, receiving coil; 6, control panel; 7, light head; 81, signal transmitting unit; 82, signal receiving unit.

DETAILED DESCRIPTION OF EMBODIMENTS

The drawings of the present invention are for illustration purpose only and are not intended to limit the present invention. Some components in the drawings may be omitted, enlarged, or reduced for better illustrating the following embodiments, and sizes of these components do not represent that of actual products. For those skilled in the art, it will be understood that some known structures and descriptions thereof in the drawings may be omitted.

Figure 2:
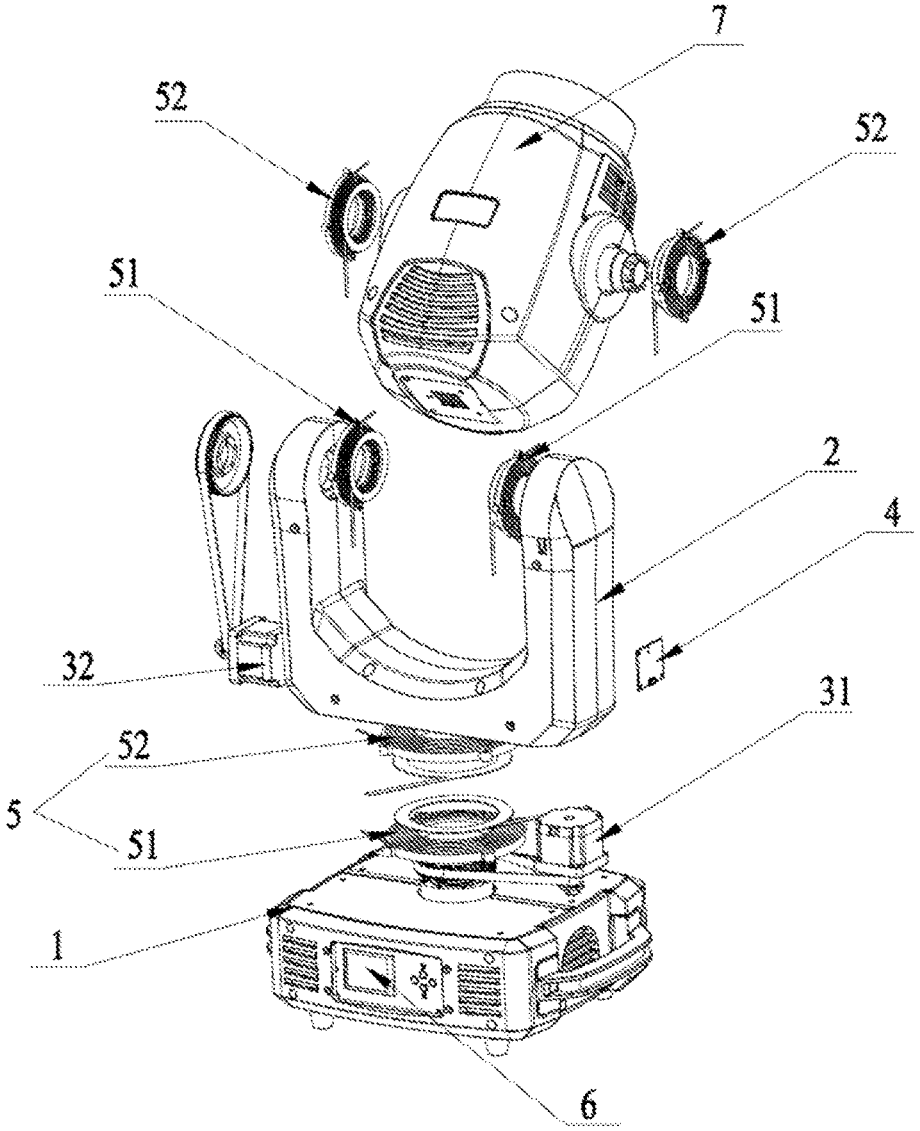
FIG. 2 is a schematic view showing a split structure of the stage light having a wireless power signal transmission system according to the embodiment.

As shown in FIGS. 1 and 2, the stage light having a wireless power signal transmission system according to an embodiment includes a base 1, a U-shaped arm 2 pivotally connected to the base, a light head 7 pivotally connected between two holding arms of the U-shaped arm 2, and a driving assembly used to drive the U-shaped arm 2 and the light head 7 to rotate. A wireless power transmission device 5 is provided at a connection portion between the base 1 and the U-shaped arm 2, and between the U-shaped arm 2 and the light head 7. The wireless power transmission device 5 includes a wireless power signal transmitting module and a wireless power signal receiving module which is matched with the wireless power signal transmitting module via a magnetically coupled wireless power signal. More specifically, in the present embodiment, three wireless power transmission devices 5 are provided, one wireless power transmission device is provided at the connection portion between the U-shaped arm 2 and the base 1, which is specifically arranged at a pivot shaft between the U-shaped arm 2 and the base 1; the other two wireless power transmission devices are provided at the connection portions between the U-shaped arm 2 and the light head 7, which are specifically arranged at the connection portions between the two holding arms of the U-shaped arm 2 and the light head 7. The wireless power signal transmitting module is arranged on the U-shaped arm 2, and the wireless power signal receiving module is provided on the light head 7 to rotate with the light head 7. The wireless power signal transmitting module includes an oscillator and a transmitting coil 51. The wireless power signal receiving module includes a receiving coil 52 and a rectifier. The transmitting coil 51 and the receiving coil 52 are both circular and are arranged opposite each other.

With the arrangement of the wireless power signal transmitting module and the wireless power signal receiving module, the present embodiment achieves the rotation of the U-shaped arm 2, without cables and wires, by only relying on that the magnetically coupled wireless power signal transmits power to the driving assembly, so that the stage light has long service life, and the U-shaped arm 2 can rotate 360 degrees infinitely. When the stage light performs scanning, an external current passes through the oscillator, a power amplifier, a filter and the transmitting coil 51 in turn to create a changing magnetic field. The receiving coil 52 of the wireless power signal receiving module converts a strong magnetic field into an electric current through electromagnetic induction, and the rectifier converts AC to DC, that is, the oscillator modulates the DC to generate an alternating current that generates a changing magnetic field, and the wireless power signal receiving module couples the changing magnetic field to generate an alternating current, which is then rectified and voltage-stabilized to provide continuous and stable power supply for the U-shaped arm, the U-shaped arm is then rotated by the driving assembly to realize scanning. The light head 7 can also rotate according to this working principle.

In this embodiment, the stage light having a wireless power signal transmission system further includes a wireless signal transmission device including a signal transmitting unit 81 and a signal receiving unit 82. The control signal between the base 1 and the U-shaped arm 2 and/or between the U-shaped arm 2 and the light head 7 is transmitted through the wireless signal transmission device without a wired connection, which is convenient for the base 1 and the U-shaped arm 2 and/or the U-shaped arm 2 and the light head 7 to achieve a relatively infinite rotation.

Figure 3:
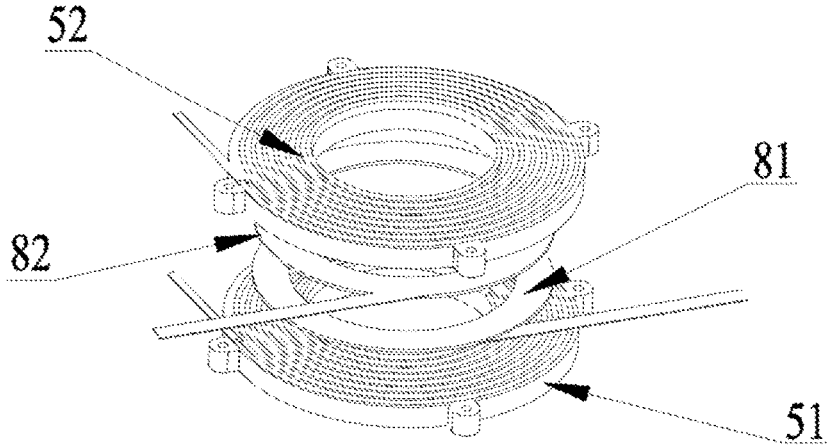
FIG. 3 is a schematic structural view of a wireless power transmission device and a wireless signal transmission device according to the embodiment.

Electromagnetic waves are used to transmit signals between the signal transmitting unit 81 and the signal receiving unit 82. The signal transmitting unit 81 is provided on the transmitting coil 51, the signal transmitting unit 82 is provided on the receiving coil 52, and both the signal transmitting unit 81 and the signal receiving unit 82 are circular and are provided opposite each other. The structure of the wireless signal transmission device and the wireless power transmission device is specifically shown in FIG. 3. The control signal of the stage light having a wireless power signal transmission system is modulated by radio frequency 2.4 G or 5.8 G and transmitted by the signal transmitting unit 81, and then the signal received by the signal receiving unit 82 is supplied to the driving assembly to complete a specified effect. When powered on, the radio frequency signal is automatically assigned with a unique identification number for matching in a frequency hopping mode, so that data of other devices can be prevented from being received by mistake, and the communication quality can be effectively improved. Further, the signal transmitting unit 81 and the signal receiving unit 82 uses a transmitting antenna with a circular appearance, which have the advantage that stable signal reception can be ensured during rotation of the U-shaped arm 2, and a situation can be avoided that the signal will be strong and weak from time to time due to distance change in relative movement of a traditional antenna.

In this embodiment, optical communication is adopted between the signal transmitting unit 81 and the signal receiving unit 82. The optical communication cannot be interfered by electromagnetic waves, and the signal transmission is more stable.

More specifically, in this embodiment, the driving assembly includes a vertical-axis motor 31 that drives the U-shaped arm 2 to rotate, a horizontal-axis motor 32 that drives the light head 7 to rotate, and a motor driving control board 4 that is electrically connected with the vertical-axis motor 31 and the horizontal-axis motor 32. The vertical-axis motor 31 is located on the base 1, and the horizontal-axis motor 32 is located in the U-shaped arm and electrically connected to the wireless power signal receiving module. The vertical-axis motor 31 drives the U-shaped arm 2 to rotate in a vertical direction, and the horizontal-axis motor 32 drives the light head 7 to rotate in a horizontal direction.

More specifically, in this embodiment, the stage light having a wireless power signal transmission system further includes a control unit single-chip microcomputer (not shown), and the base 1 is also provided with a control panel 6 that is matched with the control unit and is used to display and control the stage light having a wireless power signal transmission system. When controlling the stage light having a wireless power signal transmission system, an operator can send instructions to the control unit through the control panel 6, and then the control unit sends instructions to the wireless power signal transmitting module and the signal transmitting unit 81; the wireless power signal receiving module couples the changing magnetic field to generate an alternating current so as to supply power to the drive components; the signal receiving unit 82 receives information from the signal transmitting unit 81 and sends instructions to the motor driving control board, and the motor driving control board controls the driving motor to work so as to rotate the U-shaped arm to realize scanning.

According to another embodiment, as shown in FIG. 1, a stage light having a wireless power signal transmission system includes the base 1, the U-shaped arm 2 pivotally connected to the base 1, the light head 7 pivotally connected between two holding arms of the U-shaped arm 2, and the driving assembly used to drive the U-shaped arm 2 and the light head 7 to rotate, in which the wireless power transmission device 5 is provided at a connection portion between the base 1 and the U-shaped arm 2 and between the U-shaped arm 2 and the light head 7, and the wireless power transmission device 5 includes a wireless power signal transmitting module and a wireless power signal receiving module matched with the wireless power signal transmitting module.

Figure 4:
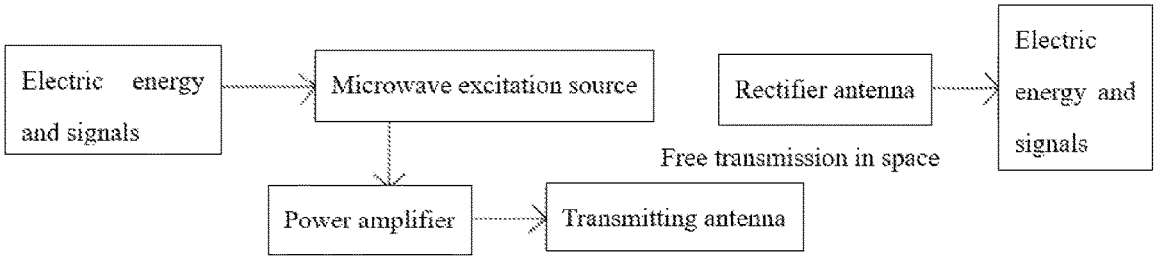
FIG. 4 is a working principle diagram of power signal transmission by microwave wireless power signal according to another embodiment.

The structure of the stage light having a wireless power signal transmission system according to this embodiment is basically the same as that of the embodiment mentioned above. The difference is that the wireless power transmission device of this embodiment uses microwave wireless power signals for power signal transmission. According to this embodiment, the wireless power signal transmitting module includes an oscillator (voltage-controlled oscillator) and a transmitting coil, in which the oscillator is provided before the transmitting coil. The wireless power signal receiving module includes a receiving coil and a rectifier (rectifier antenna), in which the rectifier is provided after the receiving coil. In this embodiment, a radio frequency signal source is used to convert a DC power/signal into a microwave signal, that is, DC-RF. A microwave power is amplified by a power amplifier (multi-stage) and radiated to a free space, and then the rectifier antenna receives and rectifies microwave energy to provide the DC power for a load and display signals. A working principle diagram of a microwave wireless power transmission signal is shown in FIG. 4.

The radio frequency signal source in this embodiment is made using a VCO and a PLL, and is generally composed of a transistor, two ordinary capacitors, a varactor diode and an inductor, which is a basic Clapp LC voltage-controlled multi-resonant oscillator. A relational expression between voltage and frequency is:

$$\omega_0 \approx \frac{1}{LC_0}\left(1+\frac{\mu_c}{\varphi}\right)^{\frac{\gamma}{2}}.$$

Figure 5:
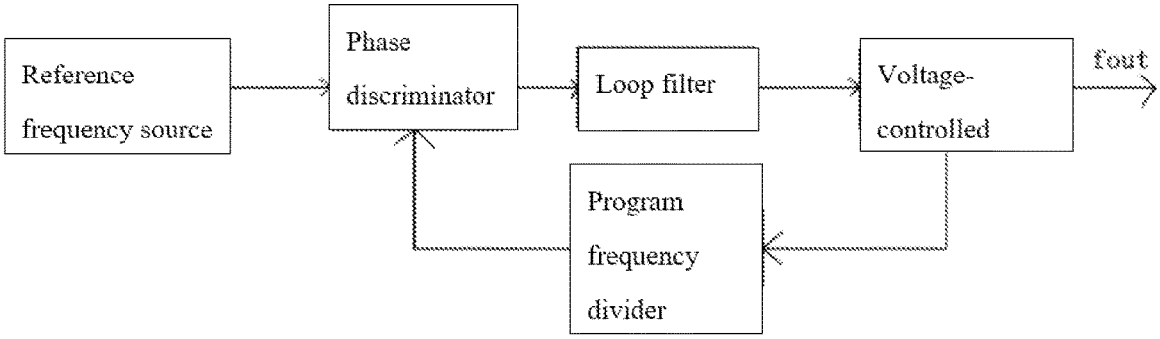
FIG. 5 is a working principle diagram of a phase-locked loop according to the embodiment.

As shown in FIG. 5, a working process of the PLL is as follows. A radio frequency signal generated by the oscillator is divided into two signals, one is for output while the other is frequency divided by a program frequency divider and then compared with external reference signals via a phase discriminator (PD). If an output frequency signal is different from a reference signal in phase, it shows that the output frequency is unstable. At this time, the input voltage of the oscillator needs to be adjusted, and then the output frequency that has a specific relationship with an input voltage is adjusted, so that a phase of the output frequency is the same as that of the reference signal, and a frequency phase is locked.

Figure 6:
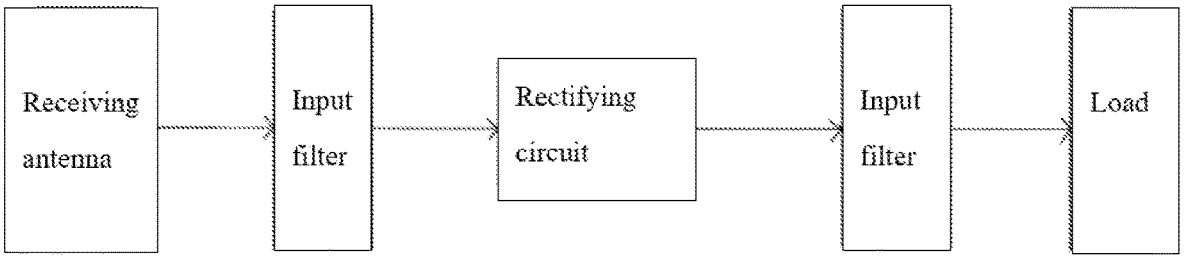
FIG. 6 is a diagram of a microwave wireless power transmission rectification system according to the embodiment.

In this embodiment, a block diagram of the rectification system including basic modules to achieve a microwave wireless power transmission is shown in FIG. 6.

Obviously, the above embodiments of the invention are merely examples for clear illustration of the technical solution of the invention, and are not intended to limit the implementation of the invention. Any modification, equivalent substitution or improvement and the like within the spirit and principle of the claims of the present invention should be included in the scope of claims of the present invention.

The invention claimed is:

1. A stage light having a wireless power signal transmission system, comprising:

a base;

a U-shaped arm pivotally connected to the base;

a light head pivotally connected between two holding arms of the U-shaped arm; and a driving assembly configured to drive the U-shaped arm and the light head to rotate, wherein a wireless power transmission device is provided at a connection portion between the U-shaped arm base and the base and/or between the U-shaped arm and the light head, and the wireless power transmission device includes a wireless power signal transmitting module and a wireless power signal receiving module which is matched with the wireless power signal transmitting module.

2. The stage light having a wireless power signal transmission system according to claim 1, wherein the wireless power signal receiving module is matched with the wireless power signal transmitting module through an electromagnetic induction wireless power signal, an electromagnetic resonance wireless power signal, a magnetically coupled wireless power signal, or a microwave wireless power signal.

3. The stage light having a wireless power signal transmission system according to claim 1, wherein the wireless power signal transmitting module includes a transmitting coil, the wireless power signal receiving module includes a receiving coil, and the transmitting coil and the receiving coil are both circular and are provided opposite each other.

4. The stage light having a wireless power signal transmission system according to claim 3, wherein the transmitting coil and the receiving coil are both sleeved on a pivot shaft between the U-shaped arm and the base.

5. The stage light having a wireless power signal transmission system according to claim 1, wherein the wireless power transmission device is provided at a connection portion between the base and the U-shaped arm, the wireless power signal transmitting module is provided on the base, and the wireless power signal receiving module is provided on the U-shaped arm so as to rotate with the U-shaped arm.

6. The stage light having a wireless power signal transmission system according to claim 1, wherein the driving assembly includes a vertical-axis motor that drives the U-shaped arm to rotate, and the vertical-axis motor is located in the base.

7. The stage light having a wireless power signal transmission system according to claim 1, wherein the wireless power transmission device is provided at a connection portion between the U-shaped arm and the light head, the wireless power signal transmitting module is provided on the U-shaped arm, and the wireless power signal receiving module is provided on the light head so as to rotate with the light head.

8. The stage light having a wireless power signal transmission system according to claim 7, wherein the wireless power transmission device is provided at connections portions between the two holding arms of the U-shaped arm and the light head.

9. The stage light having a wireless power signal transmission system according to claim 7, wherein the driving assembly further includes a horizontal-axis motor that drives the light head to rotate, and the horizontal-axis motor is located in the U-shaped arm and electrically connected to the wireless power signal receiving module.

10. The stage light having a wireless power signal transmission system according to claim 1, wherein a wireless signal transmission device is provided at a connection portion between the U-shaped arm and the base and/or between the U-shaped arm (2) and the light head, and the wireless signal transmission device includes a signal transmitting unit and a signal receiving unit.

11. The stage light having a wireless power signal transmission system according to claim 10, wherein electromagnetic waves are used to transmit signals between the signal transmitting unit and the signal receiving unit, and the signal transmitting unit and the signal receiving unit are both circular and are provided opposite each other.

12. The stage light having a wireless power signal transmission system according to claim 10, wherein optical communication is adopted between the signal transmitting unit and the signal receiving unit.

* * * * *